US011346340B2

(12) United States Patent
DeLeon, II

(10) Patent No.: US 11,346,340 B2
(45) **Date of Patent: *May 31, 2022**

(54) FLUID END CROSSBORE

(71) Applicant: S.P.M. FLOW CONTROL, INC., Fort Worth, TX (US)

(72) Inventor: Johnny Eric DeLeon, II, Fort Worth, TX (US)

(73) Assignee: SPM OIL & GAS INC., Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/943,864

(22) Filed: Jul. 30, 2020

(65) Prior Publication Data

US 2020/0355182 A1 Nov. 12, 2020

Related U.S. Application Data

(63) Continuation of application No. 16/144,155, filed on Sep. 27, 2018, now Pat. No. 10,731,643.
(Continued)

(51) Int. Cl.
*F04B 53/16* (2006.01)
*F04B 53/10* (2006.01)
*F04B 15/04* (2006.01)

(52) U.S. Cl.
CPC ..... *F04B 53/16* (2013.01); *F04B 15/04* (2013.01); *F04B 53/1032* (2013.01); *F04B 53/1087* (2013.01); *F05B 2220/20* (2013.01); *F05B 2230/10* (2013.01); *F05B 2250/314* (2013.01); *F05B 2260/406* (2013.01); *F05B 2260/95* (2013.01)

(58) Field of Classification Search
CPC ..... F04B 53/16
See application file for complete search history.

(56) References Cited

U.S. PATENT DOCUMENTS 8,662,865 B2 * 3/2014 Bayyouk ..... F04B 23/06 417/269
8,784,081 B1 * 7/2014 Blume ..... F04B 53/162 417/568

(Continued)

OTHER PUBLICATIONS

International Preliminary Report on Patentability for PCT/US2018/053098 dated Apr. 9, 2020.

*Primary Examiner* — Thomas E Lazo
(74) *Attorney, Agent, or Firm* — Foley & Lardner LLP

(57) ABSTRACT

A fluid cylinder for a reciprocating pump includes a body having inlet, outlet, and plunger bores. The inlet and outlet bores extend coaxially along a fluid passage axis. The plunger bore extends along a plunger bore axis that extends at an angle relative to the fluid passage axis. The body includes a crossbore at the intersection of the fluid passage axis and the plunger bore axis. The crossbore intersects the inlet, outlet, and plunger bores at respective inlet, outlet, and plunger bore ends. The inlet bore end and outlet bore ends are connected to the plunger bore end at respective first and second corners of the crossbore. The first corner includes a first linear bridge segment connected to the inlet and plunger bore ends by corresponding curved segments. The second corner includes a second linear bridge segment connected to the outlet and plunger bore ends by corresponding curved segments.

20 Claims, 8 Drawing Sheets

Related U.S. Application Data

(60) Provisional application No. 62/565,823, filed on Sep. 29, 2017.

(56) References Cited

U.S. PATENT DOCUMENTS

| | | | | |
|---|---|---|---|---|
| 9,297,375 | B1 * | 3/2016 | Dille | F16L 41/02 |
| 10,731,643 | B2 * | 8/2020 | DeLeon, II | F04B 53/1032 |
| 2012/0288387 | A1 * | 11/2012 | Freed | F04B 53/10 417/454 |
| 2014/0345452 | A1 * | 11/2014 | Cary | F16L 41/03 92/169.1 |

* cited by examiner

FLUID END CROSSBORE

CROSS-REFERENCE TO RELATED APPLICATION

This Application is a continuation of U.S. patent application Ser. No. 16/144,155, filed Sep. 17, 2018, entitled "FLUID END CROSSBORE," which claims priority to and the benefit of U.S. Provisional Patent Application Ser. No. 62/565,823, filed on Sep. 29, 2017 and entitled "FLUID END WITH FULLY MACHINED INTERSECTING CORSSBORE," which is incorporated herein by reference in its entirety.

TECHNICAL FIELD

This disclosure relates to reciprocating pumps, and, in particular, to the crossbores of fluid cylinders used in reciprocating pumps.

BACKGROUND OF THE DISCLOSURE

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a "frac pump." A reciprocating pump typically includes a power end and a fluid end (sometimes referred to as a cylindrical section). The fluid end is typically formed of a one piece construction or a series of blocks secured together by rods. The fluid end includes a fluid cylinder having a plunger passage for receiving a plunger or plunger throw, an inlet passage, and an outlet passage. Reciprocating pumps are oftentimes operated at pressures of 10,000 pounds per square inch (psi) and upward to 25,000 psi and at rates of up to 1,000 strokes per minute or even higher during fracturing operations.

During operation of a reciprocating pump, a fluid is pumped into the fluid cylinder through the inlet passage and out of the pump through the outlet passage. The inlet and outlet passages each include a valve assembly, which is typically opened by differential pressure of fluid and allows the fluid to flow in only one direction. A crossbore formed between the intersection of the plunger passage and the inlet and outlet passages forms a crossbore section that enables fluid to flow through the fluid cylinder. The crossbore configuration must be robust enough to handle the fluid that passes through the fluid cylinder. Th fluid often contains solid particulates and/or corrosive material that can cause corrosion, erosion, and/or pitting on surfaces of the valve assembly, the passages, and/or the crossbore over time.

Typically, the crossbores of fluid cylinders are formed using a machining process and thereafter the crossbore section is manually hand blended to remove sharp edges from the machining process. The manual hand blending process takes time and requires labor. Moreover, the manual hand blending process is not consistent across all areas of the crossbore section, can vary with every fluid cylinder, and is not representative of three-dimensional design models used for finite element analysis (FEA) and autofrettage analysis. Consequently, the manual hand blending process can create a crossbore section with different stress points, which can result in inconsistent stresses along the crossbore section. Over time, the constant flow of the abrasive fluid mixture through the pump can erode and wear down the interior surfaces and/or internal components (e.g., valves, seats, springs, etc.) of the fluid cylinder, which can eventually cause the fluid cylinder to fail. Failure of the fluid cylinder of a reciprocating pump can have relatively devastating repercussions and/or can be relatively costly.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a fluid cylinder for a reciprocating pump includes a body having comprising an inlet bore, an outlet bore, and a plunger bore. The inlet and outlet bores extend through the body approximately coaxial along a fluid passage axis. The plunger bore extends through the body along a plunger bore axis that extends at an angle relative to the fluid passage axis. The body also includes a crossbore extending through the body at the intersection of the fluid passage axis and the plunger bore axis such that the inlet bore, the outlet bore, and the plunger bore fluidly communicate with each other. The crossbore intersects the inlet bore, the outlet bore, and the plunger bore at an inlet bore end, an outlet bore end, and a plunger bore end, respectively. The inlet bore end and the outlet bore end are connected to the plunger bore end at respective first and second corners of the crossbore. The first corner includes a first linear bridge segment that is connected to the inlet bore end and the plunger bore end by corresponding curved segments. The second corner includes a second linear bridge segment that is connected to the outlet bore end and the plunger bore end by corresponding curved segments.

In some embodiments, the first linear bridge segment extends at corresponding angles relative to the plunger bore and fluid passages axes that add up to no greater than approximately 90°, and the second linear bridge segment extends at corresponding angles relative to the plunger bore and fluid passages axes that add up to no greater than approximately 90°.

In one embodiment, first linear bridge segment of the first corner extends at an angle of approximately 45° relative to the plunger bore axis and an angle of approximately 45° relative to the fluid passage axis.

In one embodiment, the second linear bridge segment of the second corner extends at an angle of approximately 45° relative to the plunger bore axis and an angle of approximately 45° relative to the fluid passage axis.

In some embodiments, the first and second corners have substantially the same geometry as each other.

In yet another embodiment, the body further includes a face extending over the crossbore. The face includes a plunger side that extends from the first corner to the second corner, an inlet side that extends from the first corner along the inlet bore end, and an outlet side that extend from the second corner along the outlet bore end. A midpoint of the face is approximately equidistant from the first and second corners.

In one embodiment, a midpoint of the face is approximately aligned with an intersection of the plunger bore axis and the fluid passage axis.

In some embodiments, the body further includes an access bore extending through the body along the plunger bore axis. The crossbore intersects the access bore at an access bore end. The access bore end is connected to the inlet and outlet bore ends at respective third and fourth corners. The third corner includes a third linear bridge segment that is connected to the access bore end and the inlet bore end by corresponding curved segments. The fourth corner includes a fourth linear bridge segment that is connected to the access bore end and the outlet bore end by corresponding curved segments.

In one embodiment, the third and fourth corners have substantially the same geometry as each other.

In one embodiment, the third linear bridge segment extends at corresponding angles relative to the plunger bore and fluid passages axes that add up to no greater than approximately 90°, and the fourth linear bridge segment extends at corresponding angles relative to the plunger bore and fluid passages axes that add up to no greater than approximately 90°.

In some embodiments, the body of the fluid cylinder is configured to be used during operation of the reciprocating pump without undergoing a manual hand blending process.

In a second aspect, a reciprocating pump assembly includes a power end portion and a fluid end portion having a fluid cylinder comprising a body having an inlet bore, an outlet bore, and a plunger bore. The inlet and outlet bores extend through the body approximately coaxial along a fluid passage axis. The plunger bore extends through the body along a plunger bore axis that extends at an angle relative to the fluid passage axis. The body further includes a crossbore extending through the body at the intersection of the fluid passage axis and the plunger bore axis such that the inlet bore, the outlet bore, and the plunger bore fluidly communicate with each other. The crossbore intersects the inlet bore, the outlet bore, and the plunger bore at an inlet bore end, an outlet bore end, and a plunger bore end, respectively. The inlet bore end and the outlet bore end are connected to the plunger bore end at respective first and second corners of the crossbore. The first corner includes a first linear bridge segment that is connected to the inlet bore end and the plunger bore end by corresponding curved segments. The second corner includes a second linear bridge segment that is connected to the outlet bore end and the plunger bore end by corresponding curved segments.

In some embodiments, the first linear bridge segment extends at corresponding angles relative to the plunger bore and fluid passages axes that add up to no greater than approximately 90°, and the second linear bridge segment extends at corresponding angles relative to the plunger bore and fluid passages axes that add up to no greater than approximately 90°.

In one embodiment, the first linear bridge segment of the first corner extends at an angle of approximately 45° relative to the plunger bore axis and an angle of approximately 45° relative to the fluid passage axis, and the second linear bridge segment of the second corner extends at an angle of approximately 45° relative to the plunger bore axis and an angle of approximately 45° relative to the fluid passage axis.

In some embodiments, the body of the fluid cylinder further includes a face extending over the crossbore. The face includes a plunger side that extends from the first corner to the second corner, an inlet side that extends from the first corner along the inlet bore end, and an outlet side that extend from the second corner along the outlet bore end. A midpoint of the face is approximately aligned with an intersection of the plunger bore axis and the fluid passage axis.

In some embodiments, the body of the fluid cylinder further includes an access bore extending through the body along the plunger bore axis. The crossbore intersects the access bore at an access bore end. The access bore end is connected to the inlet and outlet bore ends at respective third and fourth corners. The third corner includes a third linear bridge segment that is connected to the access bore end and the inlet bore end by corresponding curved segments. The fourth corner includes a fourth linear bridge segment that is connected to the access bore end and the outlet bore end by corresponding curved segments. The third linear bridge segment extends at corresponding angles relative to the plunger bore and fluid passages axes that add up to no greater than approximately 90°, and the fourth linear bridge segment extends at corresponding angles relative to the plunger bore and fluid passages axes that add up to no greater than approximately 90°.

In a third aspect, a method for fabricating a reciprocating pump having a fluid cylinder includes forming a crossbore within a body of the fluid cylinder such that an inlet bore, an outlet bore, and a plunger bore of the fluid cylinder fluidly communicate with each other, machining first and second corners of the crossbore that connect the plunger bore to the inlet and outlet bores, respectively, and assembling the reciprocating pump without performing a manual hand blending process on the first and second corners.

In some embodiments, the method further includes operating the reciprocating pump without performing a manual hand blending process on the first and second corners.

In one embodiment, machining the body of the fluid cylinder to define the first and second corners of the crossbore includes machining a first linear bridge segment of the first corner such that the first linear bridge segment is connected to the inlet bore and the plunger bore by corresponding curved segments, and machining a second linear bridge segment of the second corner such that the second linear bridge segment is connected to the outlet bore end and the plunger bore by corresponding curved segments.

In some embodiments, the method further includes machining third and fourth corners of the crossbore that connect an access bore to the inlet and outlet bores, respectively, wherein assembling the reciprocating pump further includes assembling the reciprocating pump without performing a manual hand blending process on the third and fourth corners.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

FIG. 3 is an enlarged cross-sectional view of a body of the fluid cylinder shown in

FIG. 2.

Corresponding reference characters indicate corresponding parts throughout the drawings.

DETAILED DESCRIPTION

Certain embodiments of the disclosure provide a fluid cylinder for a reciprocating pump that includes a crossbore having corners that connect a plunger bore to corresponding inlet and outlet bores. Each corner includes a linear bridge segment and corresponding curved segments that connect the linear bridge segment to the plunger bore and the inlet or outlet bore. Certain embodiments of the disclosure provide a method for fabricating the fluid cylinder that includes machining the corners of the crossbore and assembling the reciprocating pump without performing a manual blending process on the corners.

Certain embodiments of the disclosure provide intersecting bores having crossbore geometries that eliminate the need to perform manual blending processes on the corners and/or other areas of the crossbore. The crossbore geometries of certain embodiments disclosed herein provide a fluid cylinder with relatively smooth transitions between internal bores (e.g., the crossbore, inlet bores, outlet bores, plunger bores, access bores, etc.) of the fluid cylinder. Certain embodiments of the disclosure reduce stress in the crossbore (e.g., at the intersections of the crossbore with plunger, inlet, outlet, and/or access bores). The crossbore geometries of certain embodiments disclosed herein provide more consistent machined fluid cylinders having more consistent stresses in the crossbore (e.g., at the intersections of the crossbore with the plunger, inlet, outlet, and/or access bores).

The crossbore geometries of certain embodiments disclosed herein provide fluid cylinders that more closely resemble three dimensional (3D) design models used in Finite Element Analysis (FEA) and autofrettage studies, thereby improving the effectiveness of FEA and/or autofrettage studies. In at least some embodiments, the crossbore geometries disclosed herein reduce the duration of finishing operations performed on the internal bores of the fluid cylinder (e.g., a reduction of at least approximately 50%, a reduction of at least approximately 66%, a reduction of between approximately 75% and approximately 80%, etc.). The crossbore geometries of certain embodiments disclosed herein provide fluid cylinders that are more durable. The crossbore geometries of certain embodiments disclosed herein extend the operational life of fluid cylinders of reciprocating pumps. Certain embodiments of the disclosure provide crossbore geometries that reduce the time, labor, and/or cost required to fabricate the fluid cylinder of a reciprocating pump.

Figure 1:
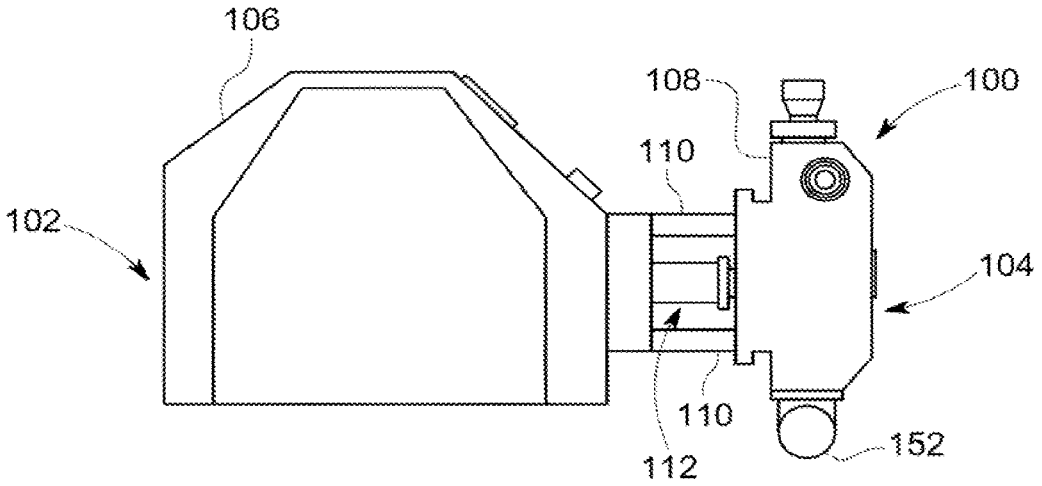
FIG. 1 is an elevational view of a reciprocating pump assembly according to an exemplary embodiment.
Figure 2:
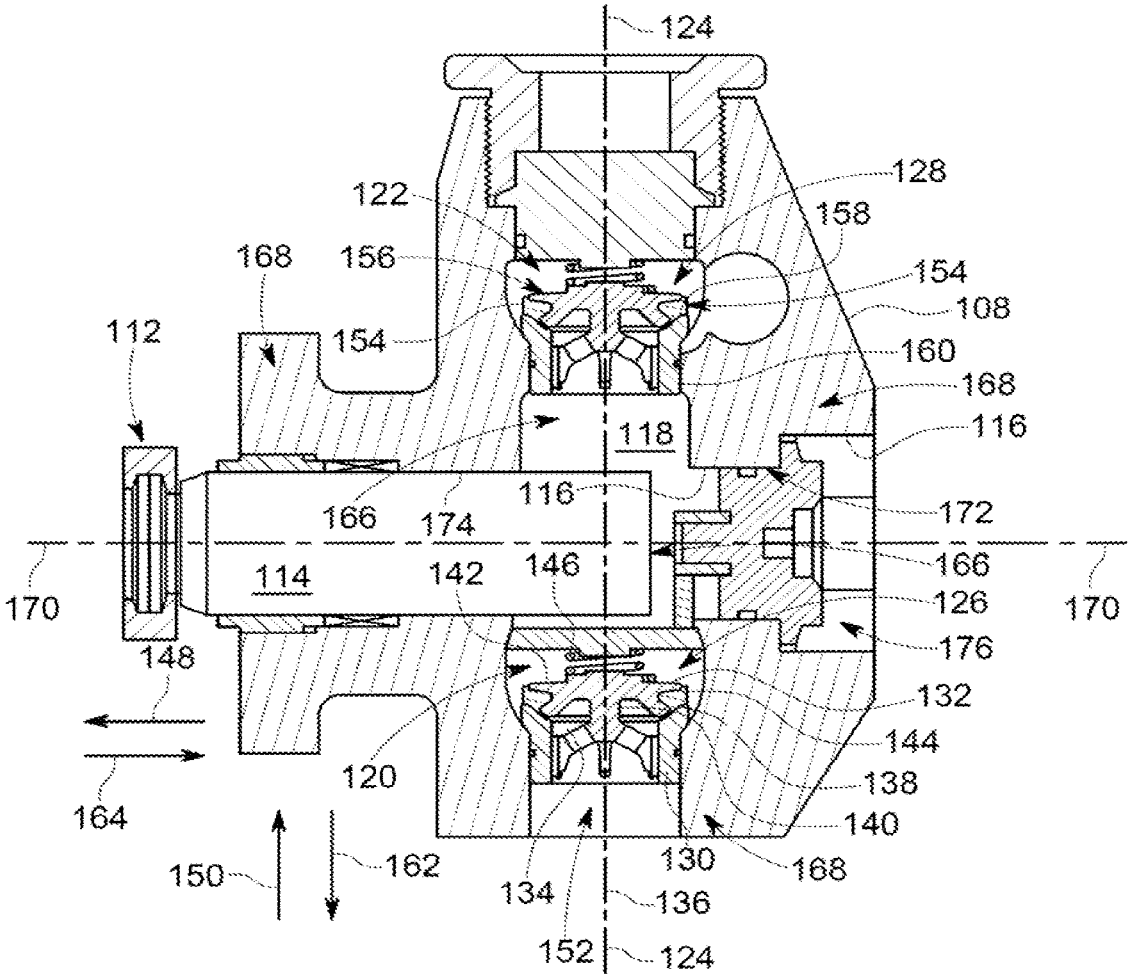
FIG. 2 is a cross-sectional view of a fluid cylinder of the reciprocating pump shown in FIG. 1 according an exemplary embodiment.

Referring to FIGS. 1 and 2, an illustrative embodiment of a reciprocating pump assembly 100 is presented. In FIGS. 1 and 2, the reciprocating pump assembly 100 includes a power end portion 102 and a fluid end portion 104 operably coupled thereto. The power end portion 102 includes a housing 106 in which a crankshaft (not shown) is disposed, the crankshaft is driven by an engine or motor (not shown). The fluid end portion 100 includes a fluid end block or fluid cylinder 108, which is connected to the housing 106 via a plurality of stay rods 110. In addition or alternatively, other connectors can be used. In operation and as discussed in further detail below, the crankshaft reciprocates a plunger rod assembly 112 between the power end portion 102 and the fluid end portion 104. According to some embodiments, the reciprocating pump assembly 100 is freestanding on the ground, is mounted to a trailer for towing between operational sites, is mounted to a skid, loaded on a manifold, otherwise transported, and/or the like. The reciprocating pump assembly 100 is not limited to frac pumps or the plunger rod pump shown herein. Rather, the embodiments disclosed herein can be used with any other type of pump that includes a crossbore.

Referring now solely to FIG. 2, the plunger rod assembly 112 includes a plunger 114 extending through a plunger bore 174 and into a pressure chamber 118 formed in the fluid cylinder 108. At least the plunger bore 174, the pressure chamber 118, and the plunger 114 together are sometimes be characterized as a "plunger throw." According to some embodiments, the reciprocating pump assembly 100 includes three plunger throws (i.e., a triplex pump assembly); however, in other embodiments, the reciprocating pump assembly 100 includes a greater or fewer number of plunger throws.

In the embodiment illustrated in FIG. 2, the fluid cylinder 108 includes fluid inlet and outlet bores 120 and 122, respectively, formed therein, which are generally coaxially disposed along a fluid passage axis 124. As described in greater detail below, fluid is adapted to flow through the fluid inlet and outlet bores 120 and 122, respectively, and along the fluid passage axis 124.

In the embodiment illustrated in FIG. 2, an inlet valve assembly 126 is disposed in the fluid inlet bore 120 and an outlet valve assembly 128 is disposed in the fluid outlet bore 122. In FIG. 2, the valve assemblies 126 and 128 are spring-loaded, which, as described in greater detail below, are actuated by at least a predetermined differential pressure across each of the valve assemblies 126 and 128. The inlet valve assembly 126 includes a valve seat 130 and a valve body 132 engaged therewith. The valve seat 130 includes a bore 134 that extends along a valve seat axis 136 that is coaxial with the fluid passage axis 124 when the inlet valve assembly 126 is disposed in the fluid inlet passage 120. The valve seat 130 further includes a tapered shoulder 138, which in the exemplary embodiment extends at an angle from the valve seat axis 136.

The valve body 132 includes a tail portion 140 and a head portion 142 that extends radially outward from the tail portion 140. The head portion 142 holds a seal 144 that sealingly engages at least a portion of the tapered shoulder 138 of the valve seat 130. In the exemplary embodiment, the head portion 142 is engaged and otherwise biased by a spring 146, which, as discussed in greater detail below, biases the valve body 132 to a closed position that prevents fluid flow through the inlet valve assembly 126.

In the embodiment illustrated in FIG. 2, the outlet valve assembly 128 is substantially similar to the inlet valve assembly 126 and therefore will not be described in further detail.

With reference to FIG. 2, operation of the reciprocating pump assembly 100 is discussed. In operation, the plunger 114 reciprocates within the plunger bore 174 for movement into and out of the pressure chamber 118. That is, the plunger 114 moves back and forth horizontally, as viewed in FIG. 2, away from and towards the fluid passage axis 124 in response to rotation of the crankshaft (not shown) that is enclosed within the housing 106. Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened. More particularly, as the plunger 114 moves away from the fluid passage axis 124 in the direction of arrow 148, the pressure inside the pressure chamber 118 decreases, creating a differential pressure across the inlet valve assembly 126 and causing the valve body 132 to move upward in the direction of arrow 150, as viewed in FIG. 2, relative to the valve seat 130. As a result of the upward movement of the valve body 132, the spring 146 is compressed and the seal 144 separates from the tapered shoulder 138 of the valve seat 130 to the open position. Fluid entering through a fluid inlet passage 152 of the fluid cylinder 108 flows along the fluid passage axis 124 and through the inlet valve assembly 126, being drawn into the pressure chamber 118. To flow through the inlet valve assembly 126, the fluid flows through the bore 134 of the valve seat 130 and along the valve seat axis 136. During the fluid flow through the inlet valve assembly 126 and into the pressure chamber 118, the outlet valve assembly 128 is in a closed position wherein a seal 154 of a valve body 156 of the outlet valve assembly 128 is engaged with a tapered shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114. At the end of the suction stroke of the plunger 114, the differential pressure across the inlet valve assembly 126 is such that the spring 146 of the inlet valve assembly 126 begins to decompress and extend, forcing the valve body 132 of the inlet valve assembly 126 to move downward in the direction of arrow 162, as viewed in FIG. 2. As a result, the inlet valve assembly 126 moves to and is otherwise placed in the closed position wherein the seal 144 of the valve body 132 is sealingly engaged with the tapered shoulder 138 of the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through the outlet valve assembly 128. As the plunger 114 reaches the end of the discharge stroke, the inlet valve assembly 126 is positioned in the closed position wherein the seal 146 is sealingly engaged with the tapered shoulder 138 of the valve seat 130.

The fluid cylinder 108 of the fluid end portion 104 includes a crossbore 166 that defines at least a portion of the pressure chamber 118. The crossbore 166 extends through a body 168 of the fluid cylinder at the intersection of the plunger bore 174, the inlet bore 120, and the outlet bore 122. More particularly, the plunger bore 174 extends through the body 168 of the fluid cylinder 108 along a plunger bore axis 170 that extends approximately perpendicular to the fluid passage axis 124. In other examples, the plunger bore axis 170 extends at an oblique angle relative to the fluid passage axis 124. In the exemplary embodiment shown in FIG. 2, the fluid cylinder 108 of the fluid end portion 104 of the reciprocating pump assembly 100 includes an optional access port 172 defined by an access bore 116 that extends through the body 168 of the fluid cylinder 108. Optionally, the access bore 116 extends through the body 168 coaxially with the plunger bore 174 (i.e., along the plunger bore axis 170), as is shown herein. The crossbore 166 extends through the body 168 at the intersection of the fluid passage axis 124 and the plunger bore axis 170 such that the plunger bore 174, the inlet bore 120, the outlet bore 122, and the access bore 116 fluidly communicate with each other.

The access port 172 provides access to the pressure chamber 118 and thereby internal components of the fluid cylinder 108 (e.g., the inlet valve assembly 146, the outlet valve assembly 148, the plunger 114, etc.) for service (e.g., maintenance, replacement, etc.) thereof. The access port 172 of the fluid cylinder 108 is closed using a suction cover assembly 176 to seal the pressure chamber 118 of the fluid cylinder 108 at the access port 172. The suction cover assembly 176 can be selectively removed to enable access to the pressure chamber 118 and thereby the internal components of the fluid cylinder 108. The access port 172 is sometimes referred to as a "maintenance" or a "suction" port.

Figure 3:
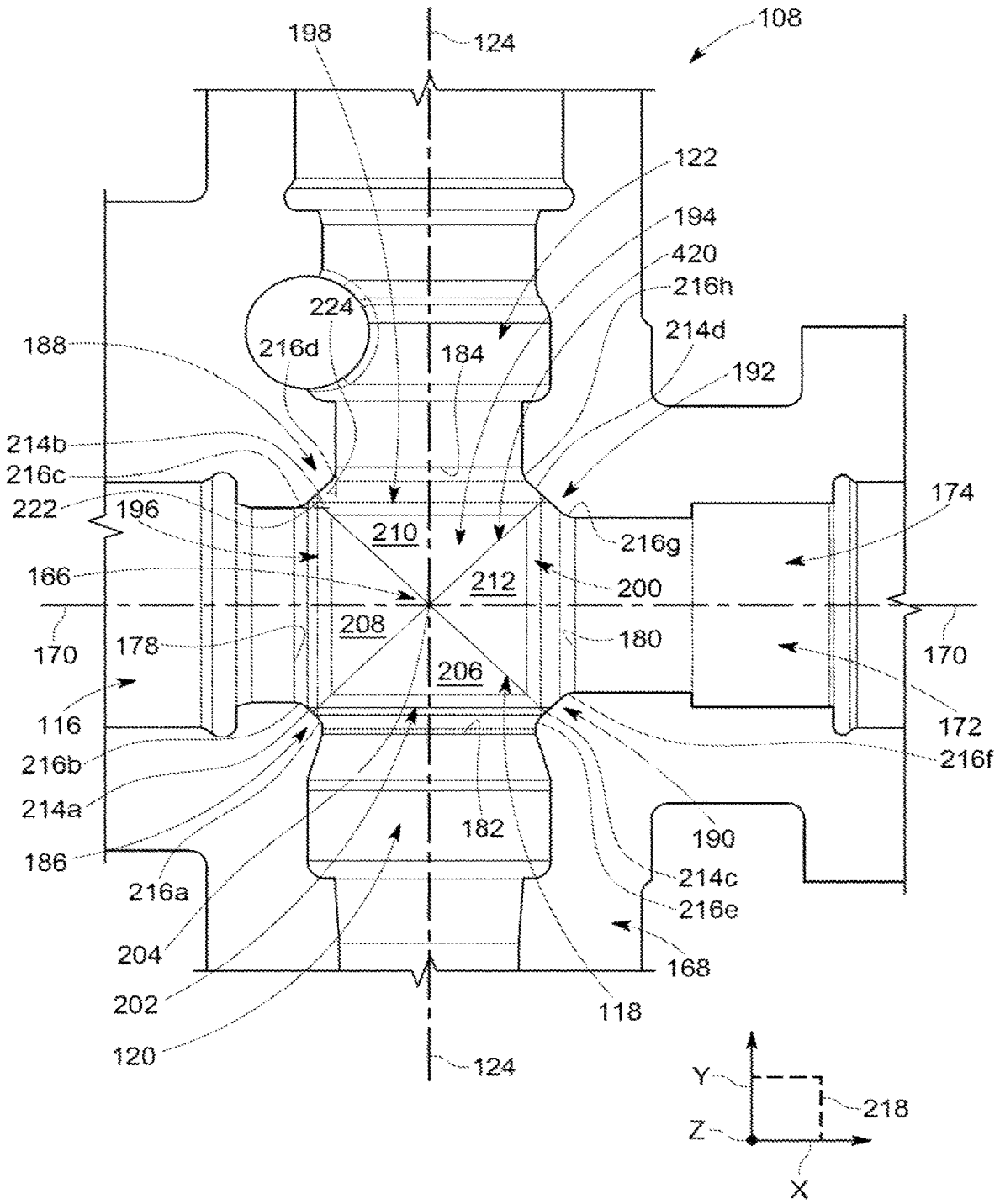
Figure 4:
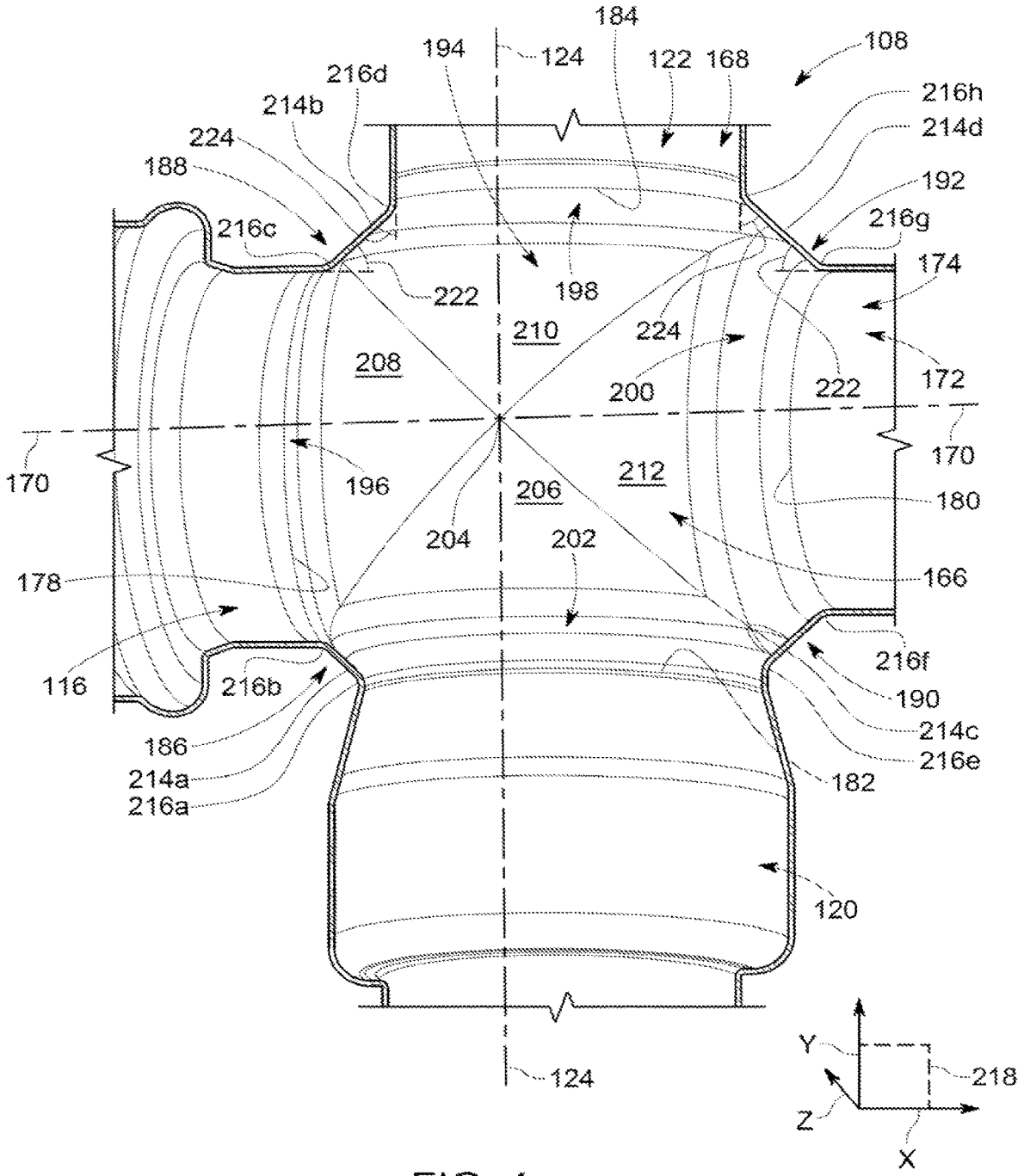
FIG. 4 is a cut-away perspective view illustrating a cross section of a portion of the fluid cylinder body shown in FIG. 3.

Referring now to FIGS. 3 and 4, the crossbore 166 will now be described. As described above, the crossbore 166 extends through the body 168 of the fluid cylinder 108 at the intersection of the fluid passage axis 124 and the plunger bore axis 170. The crossbore 166 intersects the plunger bore 174 at a plunger bore end 180 of the plunger bore 174. The crossbore 166 intersects the access bore 116 at an access bore end 178 of the access bore 116. The crossbore 166 intersects the inlet bore 120 and the outlet bore 122 at a respective inlet bore end 182 and outlet bore end 184 of the inlet and outlet bores 120 and 122, respectively.

The crossbore 166 includes a plurality of corners 186, 188, 190, and 192. The inlet bore 120 and the outlet bore 122 are connected to the access bore 116 at the corners 186 and 188, respectively. More particularly, the corner 186 extends from the inlet bore end 182 to the access bore end 178 such that the inlet bore end 182 is connected to the access bore end 178 at the corner 186. The corner 188 extends from the outlet bore end 184 to the access bore end 178 such that the outlet bore end 184 is connected to the access bore end 178 at the corner 188. The corner 186 will be referred to herein as a "third corner," while the corner 188 will be referred to herein as a "fourth corner."

The inlet bore 120 and the outlet bore 122 are connected to the plunger bore 174 at the corners 190 and 192, respectively. Specifically, the corner 190 extends from the inlet bore end 182 to the plunger bore end 180 such that the inlet bore end 182 is connected to the plunger bore end 180 at the corner 190. The corner 192 extends from the outlet bore end 184 to the plunger bore end 180 such that the outlet bore end 184 is connected to the plunger bore end 180 at the corner 192. The corner 190 will be referred to herein as a "first corner," while the corner 192 will be referred to herein as a "second corner."

In one alternative embodiment, the body 168 of the fluid cylinder 108 does not include the access port 172 (and thus does not include the access bore 116) but the crossbore 166 does include the corners 186 and 188.

The body 168 of the fluid cylinder 108 includes opposing faces 194 that extend over the crossbore 166 to define opposing boundaries of the crossbore 166. The faces 194 are considered as a portion of the structure (i.e., a component) of the crossbore 166. Only one of the faces 194 is visible herein, but it should be understood that the visible face 194 defines a boundary (e.g., a lower boundary as viewed from the orientation of FIGS. 3 and 4) of the crossbore 166 that is opposed by (i.e., faces) another substantially similar face 194 that defines an opposite boundary (e.g., an upper boundary as viewed from the orientation of FIGS. 3 and 4) of the crossbore 166. Each face 194 includes an access side 196 that extends a length along the access bore end 178 from the corner 186 to the corner 188, and an outlet side 198 that extends a length along the outlet bore end 184 from the corner 188 to the corner 192. Each face 194 includes a plunger side 200 that extends a length along the plunger bore end 180 from the corner 190 to the corner 192, and an inlet side 202 that extends a length along the inlet bore end 182 from the corner 190 to the corner 186.

In the exemplary embodiment illustrated herein, each of the sides 196, 198, 200, and 202 is curved, as can be seen in FIG. 4. More particularly, the access side 196 extends along an arcuate path between the corners 186 and 188, the outlet side 198 extends along an arcuate path between the corners 188 and 192, the plunger side 200 extends along an arcuate path between the corners 192 and 190, and the inlet side extends along an arcuate path between the corners 190 and 186. In other embodiments, one or more of the sides 196, 198, 200, and/or 202 extends along a linear (i.e., straight) path between the respective corners 186 and 188, 188 and 192, 192 and 190, and 190 and 186.

Each of the sides 196, 198, 200, and 202 can have any curvature, for example approximately 5°, approximately 10°, approximately 15°, approximately 20°, approximately 25°, approximately 30°, approximately 35°, approximately 4°, approximately 45°, etc. In the example shown in FIGS. 3 and 4, each of the sides 196, 198, 200, and 202 has approximately the same curvature as each other. In other examples, the sides 196, 198, 200, and 202 have curvatures within approximately 10% as each other. Moreover, in still other examples, one or more of the sides 196, 198, 200, and/or 202 has a different curvature as compared to one or more other sides 196, 198, 200, and/or 202.

In the example shown in FIGS. 3 and 4, each of the sides 196, 198, 200, and 202 has approximately the same length such that the sides 196 and 200 extend approximately parallel to each other and the sides 198 and 202 extend approximately parallel to each other. In other examples, the sides 196, 198, 200, and 202 have lengths within approximately 10% as each other. In some embodiments, one or more of the sides 196, 198, 200, and/or 202 has a different length as compared to one or more other sides 196, 198, 200, and/or 202. For example, in some embodiments, the sides 196 and 200 have approximately the same length as each other, while the sides 198 and 202 extend a length that is approximately the same as each other but that is different from the length of the sides 196 and 200.

The exemplary embodiment illustrates approximately equal length sides 196, 198, 200, and 202 with the plunger bore axis 170 extending approximately perpendicular to the fluid passage axis 124 such that the example of the sides 196, 198, 200, and 202 shown in FIGS. 3 and 4 forms a square, as best seen in FIG. 3. But, in some other examples, the plunger bore axis 170 and the fluid passage axis 124 are angled obliquely to each other and/or one or more of the sides 196, 198, 200, 202 has a different length from one or more other sides 196, 198, 200, and/or 202 such that the sides 196, 198, 200, and 202 form other shapes (e.g., a rhombus, a rhomboid, another parallelogram, another quadrilateral, etc.).

As shown in FIGS. 3 and 4, the approximately same lengths of the sides 196, 198, 200, and 202 provide the faces 194 with a midpoint 204 that is approximately equidistant from each of the corners 186, 188, 190, and 192 and is approximately aligned with the intersection of the plunger bore axis 170 and the fluid passage axis 124. As should be understood, changing the length of one or more of the sides 196, 198, 200, and/or 202 will shift the midpoint 204 along the plunger bore axis 170 and/or along the fluid passage axis 124. In some other embodiments, the lengths of the sides 196, 198, 200, and 202 are selected such that the midpoint 204 located approximately equidistant from pairs of the corners 186, 188, 190, and 192 (e.g., a first distance from the corners 186 and 188 and a second distance from the corners 190 and 192 that is different than the first distance). Moreover, in some embodiments the midpoint 204 is approximately equidistant from each of the sides 196, 198, 200, and 202, while in other examples the midpoint 204 is approximately equidistant from pairs of the sides 196, 198, 200, and 202. In some examples, providing the faces 194 with a midpoint 204 that is equidistant from two or more corners 196, 198, 200, and 202 of the crossbore 166 increases the strength of the body 168 of the fluid cylinder 108 along the crossbore 166, for example to thereby increase the durability of the body 168.

Optionally, the faces 194 include a curvature between the sides 196 and 200 and/or between the sides 198 and 202. For example, as shown in FIG. 4, the faces 194 includes triangle segments 206, 208, 210, and 212 that extend along an arcuate (i.e., curved) path from the respective side 196, 198, 200, and 202 to the midpoint 204. In other embodiments, one or both of the faces 194 is approximately planar (i.e., extends along an approximately planar path between the sides 196 and 200 and between the sides 198 and 202. In still other examples, one or both of the faces 194 includes triangle segments that extend along planar paths that are inclined toward or away from the axes 170 and 124.

The geometry of the corners will now be described with reference to FIGS. 3 and 4. Each corner 186, 188, 190, and 192 includes a linear bridge segment 214 and at least two corresponding curved segments 216. More particularly, the corner 186 includes a linear bridge segment 214*a* that is connected to the inlet bore end 182 by a curved segment 216*a* and is connected to the access bore end 178 by a curved segment 216*b*. The corner 188 includes a linear bridge segment 214*b* that is connected to the access bore end 178 by a curved segment 216*c* and is connected to the outlet bore end 184 by a curved segment 216*d*. Moreover, the corner 190 includes a linear bridge segment 214*c* that is connected to the inlet bore end 182 by a curved segment 216*e* and is connected to the plunger bore end 180 by a curved segment 216*f*, while the corner 192 includes a linear bridge segment 214*d* that is connected to the plunger bore end 180 by a curved segment 216*g* and is connected to the outlet bore end 184 by a curved segment 216*h*. The linear bridge segments 214*a*, 214*b*, 214*c*, and 214*d* will be referred to herein as "third," "fourth," "first," and "second" linear bridge segments, respectively.

Each linear bridge segment 214 extends along an approximately linear (i.e., straight) path between the corresponding curved segments 216. More particularly, the path between the corresponding curved segments 216 of each linear bridge segment 214 is approximately linear within a plane (e.g. the plane 218) that is parallel to the x and y-axes shown in FIGS. 3 and 4. For example, the path of the linear bridge segment 214*a* from the curved segment 216*a* to the curved segment 216*b* is approximately linear within the plane 218, while the linear bridge segment 214*b* extends along an approximately linear path from the curved segment 216*c* to the curved segment 216*d* within the plane 218. Similarly, the linear bridge segment 214*c* extends along an approximately linear path from the curved segment 216*e* to the curved segment 216*f* within the plane 218, and the path of the linear bridge segment 214*d* from the curved segment 216*g* to the curved segment 216*h* is approximately linear within the plane 218. The path of each linear bridge segment 214 may be curved within a plane that is parallel to the z axis.

Each linear bridge segment 214 extends at an angle 222 relative to the plunger bore axis 170 and an angle 224 relative to the fluid passage axis 124. The angles 222 and 224 of each linear bridge segment 214 add up to no greater than 90°. In other words, when added together, the angles 222 and 224 of each linear bridge segment 214 total 90° or less. In the exemplary embodiment illustrated in FIGS. 3 and 4, the angle 222 of each linear bridge segment 214 is approximately 45°, and the angle 224 of each linear bridge segment 214 is approximately 45°. But, each of the angles 222 and 224 of each linear bridge segment 214 can have any value so long as the angles 222 and 224 of the linear bridge segment 214 total 90° or less. For example, the angles 222 and 224 of a linear bridge segment 214 can be approximately 30° and approximately 60°, respectively, or vice versa. Another example includes a linear bridge segment 214 having angles 222 and 224 of approximately 23° and approximately 67°, respectively, or vice versa. The curved segments 216 of each linear bridge segment 214 can have any curvature that provides the corresponding linear bridge segment 214 with the selected values of the angles 222 and 224.

In some examples, two or more corners 186, 188, 190, and/or 192 have substantially the same geometry (e.g., the size of the corner, the shape of the corner, the length of the corresponding linear bridge segments 214, the values of the angles 222 and 224 of the linear bridge segments 214, the curvature of the curved segments 216, etc.) as each other. For example, in the exemplary embodiment illustrated in FIGS. 3 and 4, the corners 186 and 188 have substantially the same geometry as each other, and the corners 190 and 192 have substantially the same geometry as each other. In other examples, all four of the corners 186, 188, 190 and 192 have substantially the same geometry as each other. One non-limiting example of two corners having substantially the same geometry as each other is two corners that each have a total value of the angles 222 and 224 that is within approximately 1°-3° degrees as each other.

The crossbore geometries of certain embodiments disclosed herein (e.g., the geometry of the faces 194, the geometry of the corners 186, 188, 190, and 192, etc.) eliminate the need to perform manual hand blending processes on the corners 186, 188, 190, and 192 and/or other areas of the crossbore 166. Accordingly, the crossbore geometries of certain embodiments disclosed herein provide a fluid cylinder 108 with relatively smooth transitions between internal bores (e.g., the crossbore 166, the inlet bore 120, the outlet bore 122, the plunger bore 174, the access bore 116, etc.) of the fluid cylinder 108. Moreover, certain embodiments of the disclosure reduce stress in the crossbore 166 (e.g., at the intersections of the crossbore 166 with the bores 116, 120, 122, and/or 174), and/or provide more a consistent machined fluid cylinder 108 having more consistent stresses in the crossbore 166 (e.g., at the intersections of the crossbore 166 with the bores 116, 120, 122, and/or 174). The crossbore geometries of certain embodiments disclosed herein provide a fluid cylinder 108 that more closely resembles 3D design models used in FEA and autofrettage studies, thereby improving the effectiveness of FEA and/or autofrettage studies.

In at least some embodiments, the crossbore geometries disclosed herein reduce the duration of finishing operations performed on the bores 116, 120, 122, and/or 174 of the fluid cylinder 108. For example, by eliminating manual hand blending processes from deburring operations performed on the bores 116, 120, 122, and/or 174, the crossbore geometries disclosed herein can reduce the duration of finishing operations performed on the bores 116, 120, 122, and/or 174 by at least approximately 50% (e.g., a reduction of at least approximately 66%, a reduction of between 75% and 80%, etc.). In some embodiments, the crossbore geometries disclosed herein reduce or eliminate deburring operations. The crossbore geometries of certain embodiments disclosed herein provide a fluid cylinder 108 that are more durable and/or has an extended operational life. Certain embodiments of the disclosure provide crossbore geometries that reduce the time, labor, and/or cost required to fabricate the fluid cylinder 108.

Figure 5:
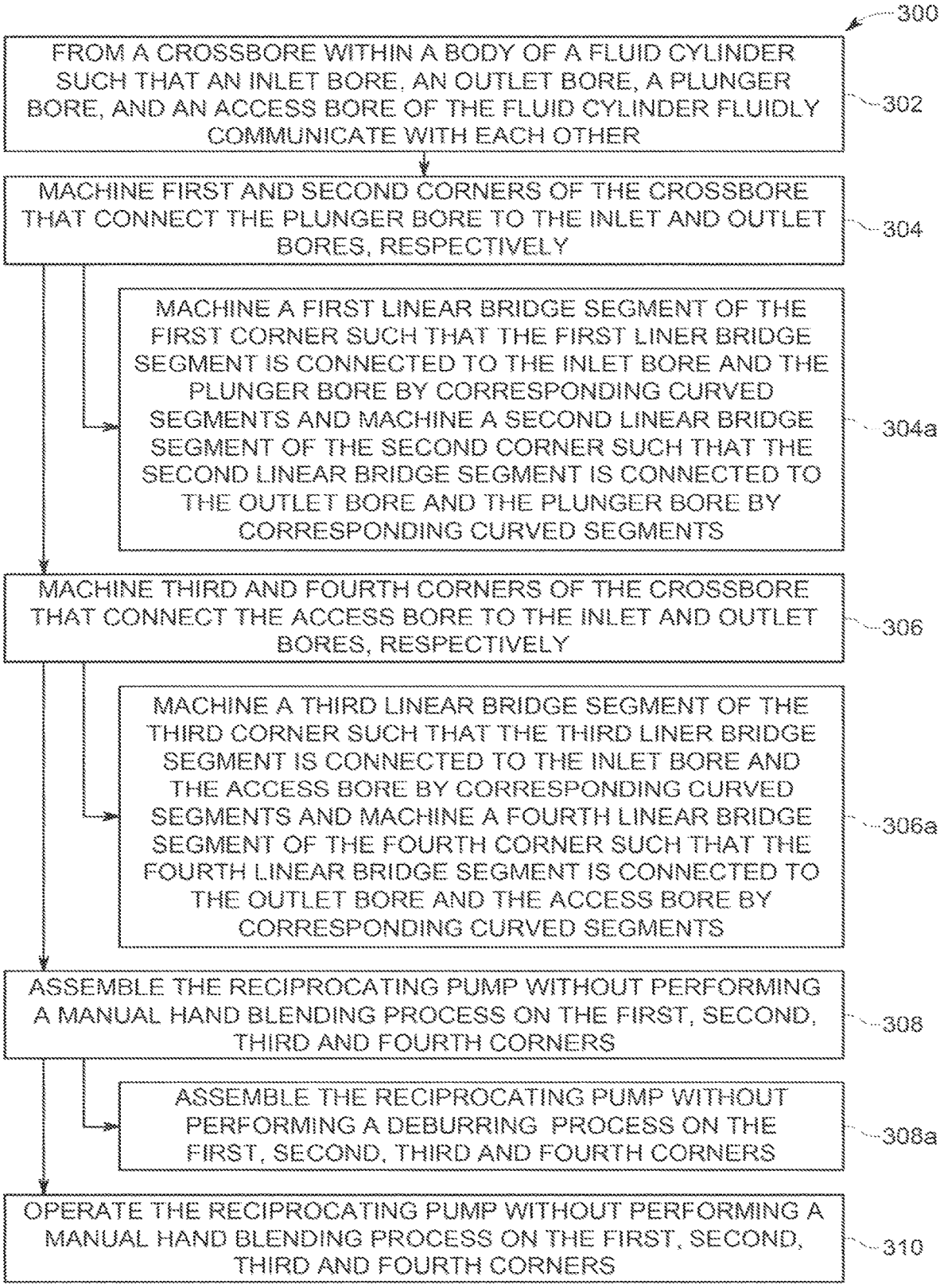
FIG. 5 is an exemplary flowchart illustrating a method for fabricating a reciprocating pump according to an exemplary embodiment.

Referring now to FIG. 5, a method 300 for fabricating a reciprocating pump according to an exemplary embodiment is shown. At step 302, the method 300 includes forming a crossbore within a body of a fluid cylinder such that an inlet bore, an outlet bore, a plunger bore, and an access bore of the fluid cylinder fluidly communicate with each other. At step 304, the method 300 includes machining first and second corners of the crossbore that connect the plunger bore to the inlet and outlet bores, respectively.

Optionally, machining, at 304, the body of the fluid cylinder to define the first and second corners of the crossbore includes machining, at 304*a*, a first linear bridge segment of the first corner such that the first linear bridge segment is connected to the inlet bore and the plunger bore by corresponding curved segments, and machining, at 304*a*, a second linear bridge segment of the second corner such that the second linear bridge segment is connected to the outlet bore end and the plunger bore by corresponding curved segments.

At step 306, the method 300 includes machining third and fourth corners of the crossbore that connect the access bore to the inlet and outlet bores, respectively.

Optionally, machining, at 306, the body of the fluid cylinder to define the third and fourth corners of the crossbore includes machining, at 306*a*, a third linear bridge segment of the third corner such that the third linear bridge segment is connected to the inlet bore and the access bore by corresponding curved segments, and machining, at 306*a*, a fourth linear bridge segment of the fourth corner such that the fourth linear bridge segment is connected to the outlet bore end and the access bore by corresponding curved segments.

At step 308, the method includes assembling the reciprocating pump without performing a manual hand blending process on the first, second, third, and fourth corners. In some embodiments, assembling, at 308, the reciprocating pump includes assembling, at 308*a*, the reciprocating pump without performing a deburring process on the first, second, third, and fourth corners.

In some embodiments, the method 300 includes operating, at step 310, the reciprocating pump without performing a manual hand blending process on the first, second, third, and fourth corners.

EXAMPLES

The results of stress tests performed to measure the stress of an exemplary crossbore 166 of the fluid cylinder 108 are illustrated in FIGS. 6-9. The stress tests of FIGS. 6-9 were performed on fluid cylinders 108 that were not subjected to any manual hand blending process. In other words, the crossbores 166 of the fluid cylinders shown in FIGS. 6-9 were not manually hand blended prior to the testing shown.

Figure 6:
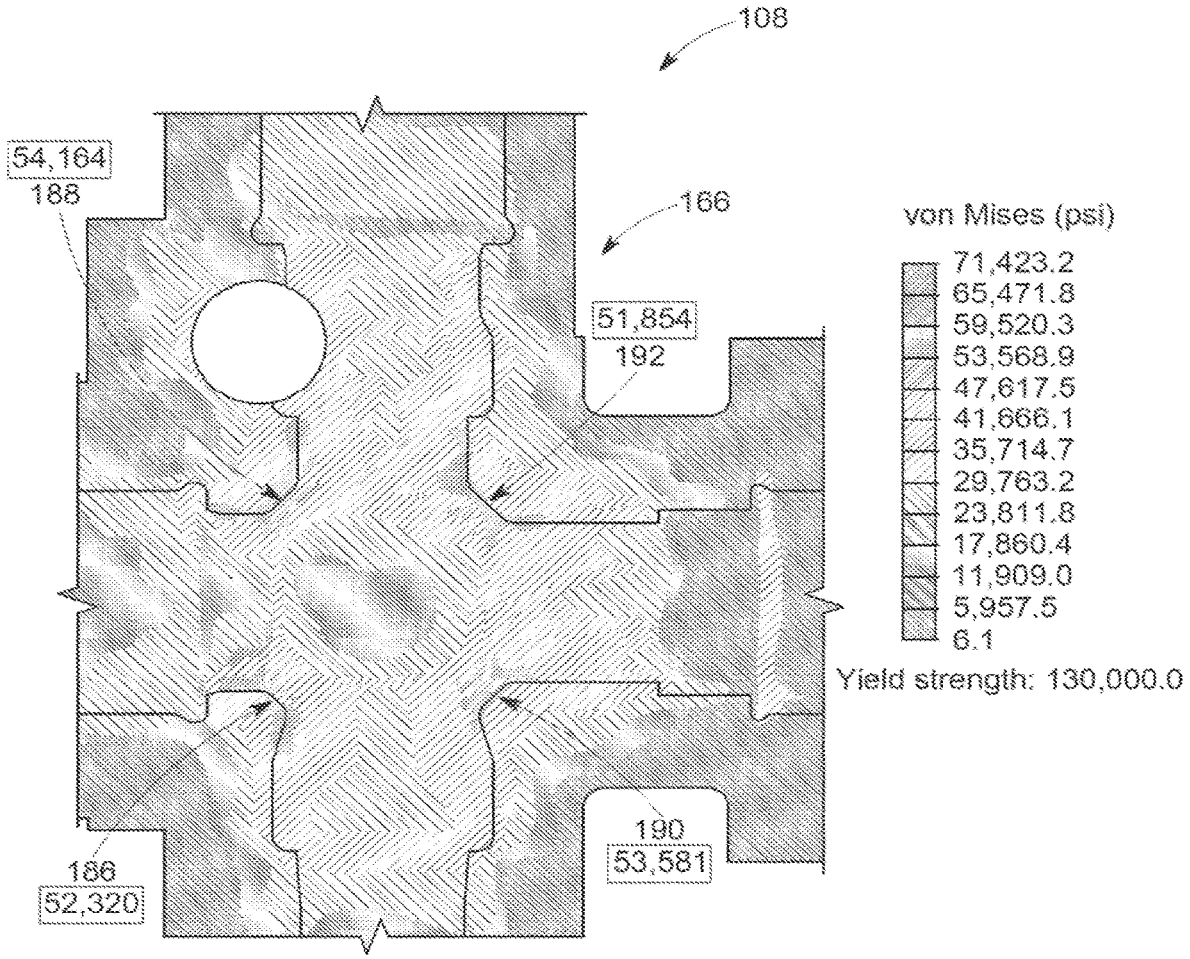
FIGS. 6-8 are cross-sectional views of a fluid cylinder illustrating the results of various stress tests.
Figure 7:
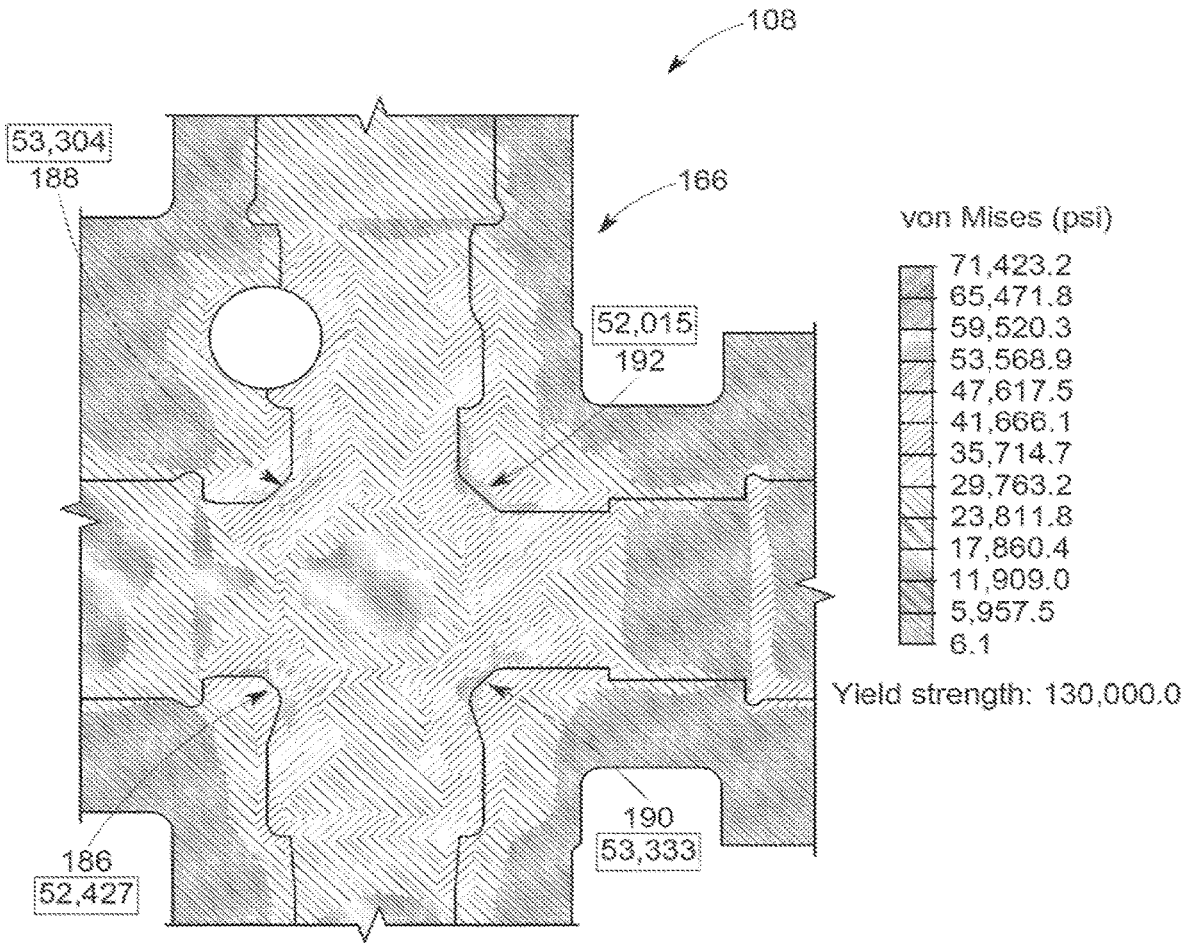
Figure 8:
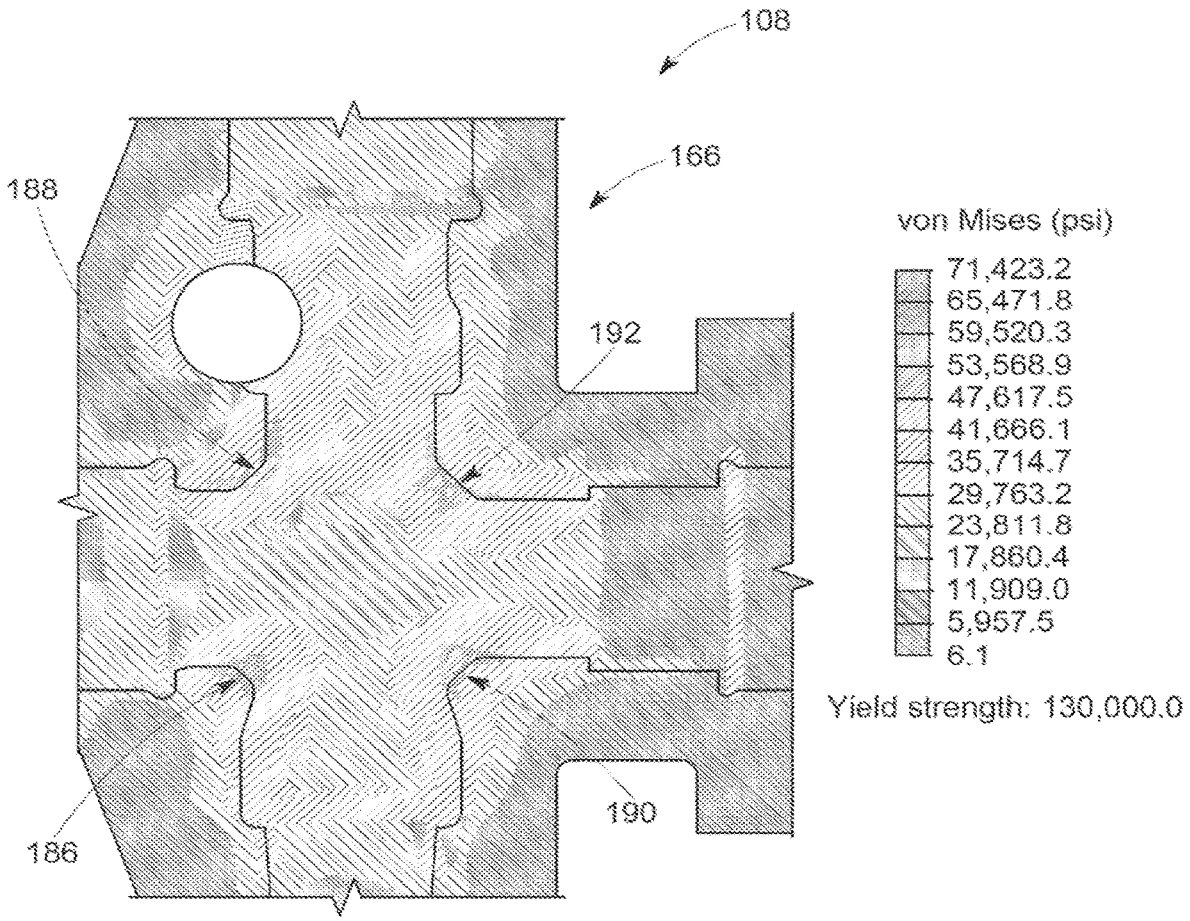

The tests shown in FIGS. 6 and 7 illustrate Von Mises pressure scores measured in pounds per square inch (psi)) at the corners 186, 188, 190, and 192. For both tests of FIGS. 6 and 7, the pressures measured at the corners 186, 188, 190, and 192 are within 5% of each other. Specifically, the following pressures were experienced at the corners 186, 188, 190, and 192 in the test shown in FIG. 6:

Corner 186—52,320 psi
Corner 188—54,164 psi
Corner 190—53,581 psi
Corner 192—51,854 psi In FIG. 7, the following pressures were experienced at the corners 186, 188, 190, and 192:

Corner 186—52,427 psi
Corner 188—53,304 psi
Corner 190—52,015 psi
Corner 192—53,333 psi As described above, the corners 186, 188, 190, and 192 did not experience a stress load greater than 5% of the stress felt at the other corners 186, 188, 190, and 192 in either of the tests shown in FIGS. 6 and 7. Additional tests were performed that yielded similar results. For example, FIG. 8 illustrates an indication of the stresses experienced at the corners 186, 188, 190, and 192 under another stress test. As can be seen visually, the stresses do not appear to be substantially different at the various corners 186, 188, 190, and 192. The test illustrated in FIG. 8 reiterates the Von Mises scores in FIGS. 6 and 7, indicating that the stresses at the corners 186, 188, 190, and 192 of the crossbore 166 do not differ more than 5%.

Figure 9:
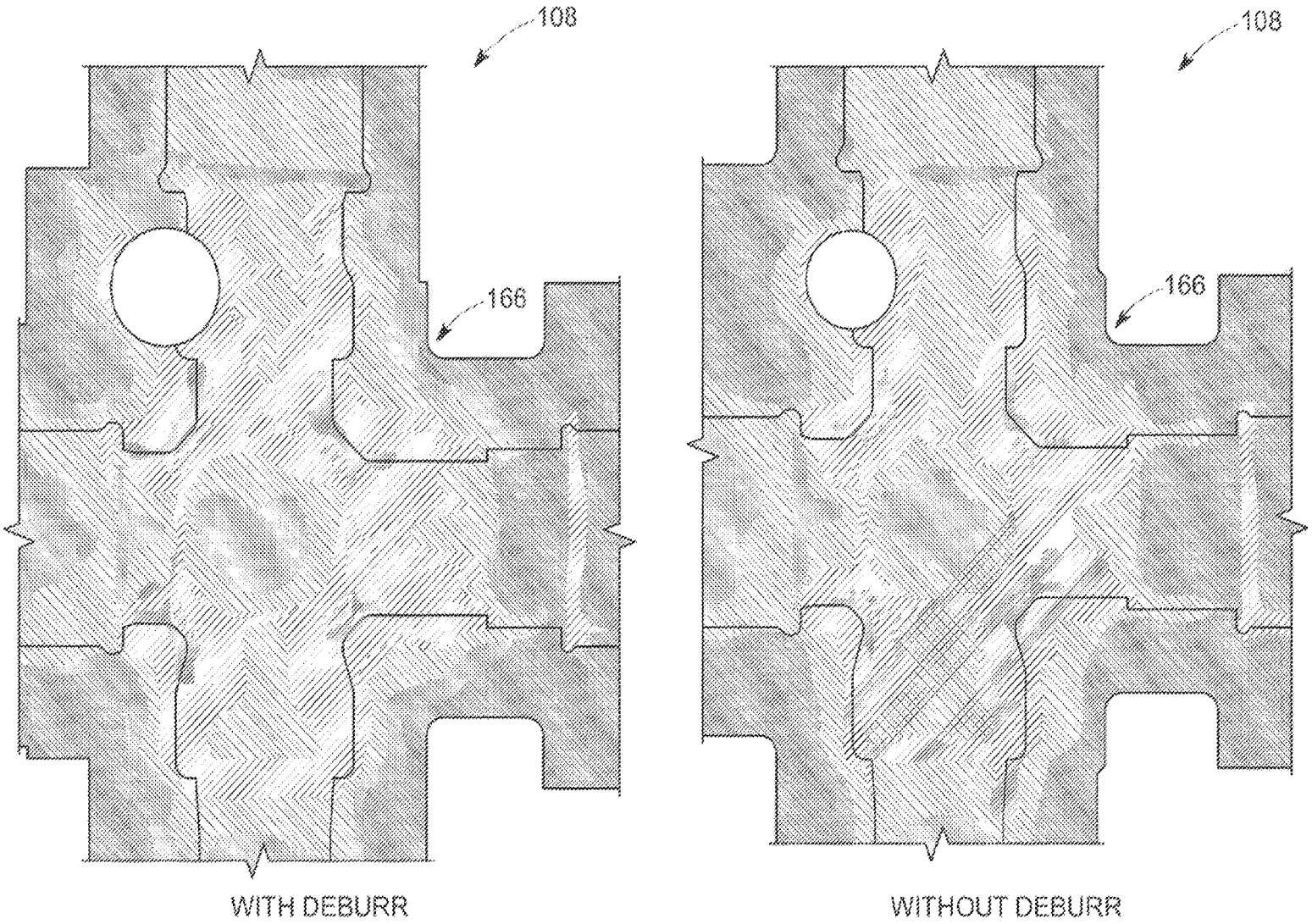
FIG. 9 is a cross-sectional side-by-side view of two fluid cylinders illustrating the results of a stress test.

FIG. 9 illustrates side-by-side results of stress tests performed on the fluid cylinder 108 with and without deburring. The side-by-side cross sections shown in FIG. 9 illustrate that deburring did not significantly impact the stress experienced in crossbore 166. As shown, the stress profiles of the deburred fluid cylinder 108 and the non-deburred fluid cylinder 108 are nearly identical.

Accordingly, the stress test shown in FIGS. 6-9 illustrate that the geometric profiles of the crossbore 166 described and illustrated herein provide stress displacement between the corners 186, 188, 190, and 192 without performing a manual hand blending process on the crossbores 166. Moreover, the stress tests shown in FIG. 9 illustrate that the geometric profiles of the crossbore 166 described and illustrated herein provide stress displacement between the corners 186, 188, 190, and 192 without performing a deburring process on the crossbores 166. The stress tests shown in FIGS. 6-9 thus illustrate that crossbore geometries of certain embodiments disclosed herein eliminate the need to perform manual hand blending processes on the crossbore 166.

The following clauses describe further aspects of the disclosure:

Clause Set A:

A1. A fluid cylinder for a reciprocating pump, said fluid cylinder comprising:

a body comprising an inlet bore, an outlet bore, and a plunger bore, the inlet and outlet bores extending through the body approximately coaxial along a fluid passage axis, the plunger bore extending through the body along a plunger bore axis that extends at an angle relative to the fluid passage axis, the body further comprising a crossbore extending through the body at the intersection of the fluid passage axis and the plunger bore axis such that the inlet bore, the outlet bore, and the plunger bore fluidly communicate with each other, the crossbore intersecting the inlet bore, the outlet bore, and the plunger bore at an inlet bore end, an outlet bore end, and a plunger bore end, respectively; and wherein the inlet bore end and the outlet bore end are connected to the plunger bore end at respective first and second corners of the crossbore, the first corner comprising a first linear bridge segment that is connected to the inlet bore end and the plunger bore end by corresponding curved segments, the second corner comprising a second linear bridge segment that is connected to the outlet bore end and the plunger bore end by corresponding curved segments.

A2. The fluid cylinder of clause A1, wherein the first linear bridge segment extends at corresponding angles relative to the plunger bore and fluid passages axes that add up to no greater than approximately 90°, the second linear bridge segment extending at corresponding angles relative to the plunger bore and fluid passages axes that add up to no greater than approximately 90°.

A3. The fluid cylinder of clause A1, wherein the first linear bridge segment of the first corner extends at an angle of approximately 45° relative to the plunger bore axis and an angle of approximately 45° relative to the fluid passage axis.

A4. The fluid cylinder of clause A1, wherein the second linear bridge segment of the second corner extends at an angle of approximately 45° relative to the plunger bore axis and an angle of approximately 45° relative to the fluid passage axis.

A5. The fluid cylinder of clause A1, wherein the first and second corners have substantially the same geometry as each other.

A6. The fluid cylinder of clause A1, wherein the body further comprises a face extending over the crossbore, the face comprising a plunger side that extends from the first corner to the second corner, an inlet side that extends from the first corner along the inlet bore end, and an outlet side that extend from the second corner along the outlet bore end, wherein a midpoint of the face is approximately equidistant from the first and second corners.

A7. The fluid cylinder of clause A1, wherein the body further comprises a face extending over the crossbore, the face comprising a plunger side that extends from the first corner to the second corner, an inlet side that extends from the first corner along the inlet bore end, and an outlet side that extend from the second corner along the outlet bore end, wherein a midpoint of the face is approximately aligned with an intersection of the plunger bore axis and the fluid passage axis.

A8. The fluid cylinder of clause A1, wherein the body further comprises an access bore extending through the body along the plunger bore axis, the crossbore intersecting the access bore at an access bore end, the access bore end being connected to the inlet and outlet bore ends at respective third and fourth corners, the third corner comprising a third linear bridge segment that is connected to the access bore end and the inlet bore end by corresponding curved segments, the fourth corner comprising a fourth linear bridge segment that is connected to the access bore end and the outlet bore end by corresponding curved segments.

A9. The fluid cylinder of clause A1, wherein the body further comprises an access bore extending through the body along the plunger bore axis, the crossbore intersecting the access bore at an access bore end, the access bore end being connected to the inlet and outlet bore ends at respective third and fourth corners, the third corner comprising a third linear bridge segment that is connected to the access bore end and the inlet bore end by corresponding curved segments, the fourth corner comprising a fourth linear bridge segment that is connected to the access bore end and the outlet bore end by corresponding curved segments, wherein the third and fourth corners have substantially the same geometry as each other.

A10. The fluid cylinder of clause A1, wherein the body further comprises an access bore extending through the body along the plunger bore axis, the crossbore intersecting the access bore at an access bore end, the access bore end being connected to the inlet and outlet bore ends at respective third and fourth corners, the third corner comprising a third linear bridge segment that is connected to the access bore end and the inlet bore end by corresponding curved segments, the fourth corner comprising a fourth linear bridge segment that is connected to the access bore end and the outlet bore end by corresponding curved segments, wherein the third linear bridge segment extends at corresponding angles relative to the plunger bore and fluid passages axes that add up to no greater than approximately 90°, and the fourth linear bridge segment extends at corresponding angles relative to the plunger bore and fluid passages axes that add up to no greater than approximately 90°.

A11. The fluid cylinder of clause A1, wherein the body of the fluid cylinder is configured to be used during operation of the reciprocating pump without undergoing a manual hand blending process.

Clause Set B:

B1. A reciprocating pump assembly comprising a power end portion; and a fluid end portion having a fluid cylinder comprising a body having an inlet bore, an outlet bore, and a plunger bore, the inlet and outlet bores extending through the body approximately coaxial along a fluid passage axis, the plunger bore extending through the body along a plunger bore axis that extends at an angle relative to the fluid passage axis, the body further comprising a crossbore extending through the body at the intersection of the fluid passage axis and the plunger bore axis such that the inlet bore, the outlet bore, and the plunger bore fluidly communicate with each other, the crossbore intersecting the inlet bore, the outlet bore, and the plunger bore at an inlet bore end, an outlet bore end, and a plunger bore end, respectively, wherein the inlet bore end and the outlet bore end are connected to the plunger bore end at respective first and second corners of the crossbore, the first corner comprising a first linear bridge segment that is connected to the inlet bore end and the plunger bore end by corresponding curved segments, the second corner comprising a second linear bridge segment that is connected to the outlet bore end and the plunger bore end by corresponding curved segments.

B2. The reciprocating pump assembly of clause B1, wherein the first linear bridge segment extends at corresponding angles relative to the plunger bore and fluid passages axes that add up to no greater than approximately 90°, the second linear bridge segment extending at corresponding angles relative to the plunger bore and fluid passages axes that add up to no greater than approximately 90°.

B3. The reciprocating pump assembly of clause B1, wherein the first linear bridge segment of the first corner extends at an angle of approximately 45° relative to the plunger bore axis and an angle of approximately 45° relative to the fluid passage axis, and wherein the second linear bridge segment of the second corner extends at an angle of approximately 45° relative to the plunger bore axis and an angle of approximately 45° relative to the fluid passage axis.

B4. The reciprocating pump assembly of clause B1, wherein the body of the fluid cylinder further comprises a face extending over the crossbore, the face comprising a plunger side that extends from the first corner to the second corner, an inlet side that extends from the first corner along the inlet bore end, and an outlet side that extend from the second corner along the outlet bore end, wherein a midpoint of the face is approximately aligned with an intersection of the plunger bore axis and the fluid passage axis.

B4. The reciprocating pump assembly of clause B1, wherein the body of the fluid cylinder further comprises an access bore extending through the body along the plunger bore axis, the crossbore intersecting the access bore at an access bore end, the access bore end being connected to the inlet and outlet bore ends at respective third and fourth corners, the third corner comprising a third linear bridge segment that is connected to the access bore end and the inlet bore end by corresponding curved segments, the fourth corner comprising a fourth linear bridge segment that is connected to the access bore end and the outlet bore end by corresponding curved segments, wherein the third linear bridge segment extends at corresponding angles relative to the plunger bore and fluid passages axes that add up to no greater than approximately 90°, and the fourth linear bridge segment extends at corresponding angles relative to the plunger bore and fluid passages axes that add up to no greater than approximately 90°.

Clause Set C:

C1. A method for fabricating a reciprocating pump having a fluid cylinder, said method comprising:

forming a crossbore within a body of the fluid cylinder such that an inlet bore, an outlet bore, and a plunger bore of the fluid cylinder fluidly communicate with each other;

machining first and second corners of the crossbore that connect the plunger bore to the inlet and outlet bores, respectively; and assembling the reciprocating pump without performing a manual hand blending process on the first and second corners.

C2. The method of clause C1, further comprising operating the reciprocating pump without performing a manual hand blending process on the first and second corners.

C3. The method of clause C1, wherein machining the body of the fluid cylinder to define the first and second corners of the crossbore comprises:

machining a first linear bridge segment of the first corner such that the first linear bridge segment is connected to the inlet bore and the plunger bore by corresponding curved segments; and machining a second linear bridge segment of the second corner such that the second linear bridge segment is connected to the outlet bore end and the plunger bore by corresponding curved segments.

C4. The method of clause C1, further comprising machining third and fourth corners of the crossbore that connect an access bore to the inlet and outlet bores, respectively, wherein assembling the reciprocating pump further comprises assembling the reciprocating pump without performing a manual hand blending process on the third and fourth corners.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise," "left" and right," "front" and "rear," "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word "comprising" is to be understood in its "open" sense, that is, in the sense of "including," and thus not limited to its "closed" sense, that is the sense of "consisting only of." A corresponding meaning is to be attributed to the corresponding words "comprise," "comprised," "comprises," "having," "has," "includes," and "including" where they appear. The term "exemplary" is intended to mean "an example of." The phrase "one or more of the following: A, B, and C" means "at least one of A and/or at least one of B and/or at least one of C." Moreover, in the following claims, the terms "first," "second," "third," and "fourth," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A fluid cylinder for a reciprocating pump, said fluid cylinder comprising:

a body comprising an inlet bore, an outlet bore, a plunger bore, and a crossbore extending through the body, the crossbore fluidly connecting the inlet bore, the outlet bore, and the plunger bore and intersecting the inlet bore, the outlet bore, and the plunger bore at an inlet bore end, an outlet bore end, and a plunger bore end, respectively; and wherein the inlet bore end is connected to the plunger bore end at a first corner of the crossbore, the first corner comprising a first linear bridge segment that is connected to the inlet bore end and the plunger bore end by corresponding curved segments.

2. The fluid cylinder of claim 1, wherein the outlet bore end is connected to the plunger bore end at a second corner of the crossbore, the second corner comprising a second linear bridge segment that is connected to the outlet bore end and the plunger bore end by corresponding curved segments.

3. The fluid cylinder of claim 2, wherein the first corner and the second corner have substantially the same geometry as each other.

4. The fluid cylinder of claim 2, wherein the body further comprises a face extending over the crossbore, the face comprising a plunger side that extends from the first corner to the second corner, an inlet side that extends from the first corner along the inlet bore end, and an outlet side that extends from the second corner along the outlet bore end, wherein a midpoint of the face is approximately equidistant from the first corner and the second corner.

5. The fluid cylinder of claim 2, wherein the body further comprises an access bore extending through the body, the crossbore intersecting the access bore at an access bore end, wherein the access bore end is connected to one of the inlet bore end and the outlet bore end at a third corner of the crossbore, the third corner comprising a third linear bridge segment that is connected to the access bore end and the one of the inlet bore end and the outlet bore end by corresponding curved segments.

6. The fluid cylinder of claim 5, wherein the access bore end is connected to the other of the inlet bore end and the outlet bore end at a fourth corner of the crossbore, the fourth corner comprising a fourth linear bridge segment that is connected to the access bore end and the other of the inlet bore end and the outlet bore end by corresponding curved segments.

7. The fluid cylinder of claim 6, wherein the third corner and the fourth corner have substantially the same geometry as each other.

8. The fluid cylinder of claim 6, wherein the inlet bore and the outlet bore extend through the body approximately coaxial along a fluid passage axis, wherein the plunger bore and the access bore extend through the body approximately coaxial along a plunger bore axis that extends at an angle relative to the fluid passage axis, wherein the third linear bridge segment extends at corresponding angles relative to the plunger bore axis and the fluid passage axis that add up to no greater than approximately 90°, and the fourth linear bridge segment extends at corresponding angles relative to the plunger bore axis and the fluid passage axis that add up to no greater than approximately 90°.

9. The fluid cylinder of claim 1, wherein the inlet bore and the outlet bore extend through the body approximately coaxial along a fluid passage axis, wherein the plunger bore extends through the body along a plunger bore axis that extends at an angle relative to the fluid passage axis, wherein the crossbore is positioned at an intersection of the fluid passage axis and the plunger bore axis.

10. The fluid cylinder of claim 9, wherein the first linear bridge segment extends at corresponding angles relative to the plunger bore axis and the fluid passage axis that add up to no greater than approximately 90°.

11. The fluid cylinder of claim 9, wherein the first linear bridge segment of the first corner extends at an angle of approximately 45° relative to the plunger bore axis and an angle of approximately 45° relative to the fluid passage axis.

12. The fluid cylinder of claim 9, wherein the body further comprises a face extending over the crossbore, the face comprising a plunger side that extends from the first corner to the second corner, an inlet side that extends from the first corner along the inlet bore end, and an outlet side that extends from the second corner along the outlet bore end, wherein a midpoint of the face is approximately aligned with the intersection of the fluid passage axis and the plunger bore axis.

13. The fluid cylinder of claim 1, wherein the body of the fluid cylinder is configured to be formed and assembled as a part of the reciprocating pump without undergoing a manual hand blending process.

14. A fluid cylinder for a reciprocating pump, said fluid cylinder comprising:

a body comprising an inlet bore, an outlet bore, a plunger bore, and a crossbore extending through the body, the crossbore fluidly connecting the inlet bore, the outlet bore, and the plunger bore and intersecting the inlet bore, the outlet bore, and the plunger bore at an inlet bore end, an outlet bore end, and a plunger bore end, respectively; and wherein the outlet bore end is connected to the plunger bore end at a corner of the crossbore, the corner comprising a linear bridge segment that is connected to the outlet bore end and the plunger bore end by corresponding curved segments.

15. The fluid cylinder of claim 14, wherein the inlet bore and the outlet bore extend through the body approximately coaxial along a fluid passage axis, wherein the plunger bore extends through the body along a plunger bore axis that extends at an angle relative to the fluid passage axis, wherein the crossbore is positioned at an intersection of the fluid passage axis and the plunger bore axis.

16. The fluid cylinder of claim 15, wherein the linear bridge segment extends at corresponding angles relative to the plunger bore axis and the fluid passage axis that add up to no greater than approximately 90°.

17. The fluid cylinder of claim 15, wherein the linear bridge segment of the corner extends at an angle of approximately 45° relative to the plunger bore axis and an angle of approximately 45° relative to the fluid passage axis.

18. A method for fabricating a fluid cylinder for a reciprocating pump, said method comprising:

forming a crossbore within a body of the fluid cylinder such that an inlet bore, an outlet bore, and a plunger bore of the fluid cylinder fluidly communicate with each other; and machining a first corner of the crossbore that connects the plunger bore to one of the inlet bore and the outlet bore, wherein machining the body of the fluid cylinder to define the first corner of the crossbore comprises:

machining a first linear bridge segment of the first corner such that the first linear bridge segment is connected to the plunger bore and the one of the inlet bore and the outlet bore by corresponding curved segments.

19. The method of claim 18, further comprising machining a second corner of the crossbore that connects the plunger bore to the other of the inlet bore and the outlet bore, wherein machining the body of the fluid cylinder to define the second corner of the crossbore comprises:

machining a second linear bridge segment of the second corner such that the second linear bridge segment is connected to the plunger bore and the other of the inlet bore and the outlet bore by corresponding curved segments.

20. The method of claim 18, wherein the fluid cylinder is configured such that fabricating the fluid cylinder for assembly as a part of the reciprocating pump is performed without undergoing a manual hand blending process.

* * * * *